US007082705B1

(12) United States Patent
Glenn

(10) Patent No.: US 7,082,705 B1
(45) Date of Patent: Aug. 1, 2006

(54) IRONING BOARD COVER WITH PANEL AND METHODS OF USE

(75) Inventor: James L. Glenn, St. Albans, MO (US)

(73) Assignee: Whitney Design, Inc., Bridgeton, MO (US)

( * ) Notice: Subject to any disclaimer, the term of this patent is extended or adjusted under 35 U.S.C. 154(b) by 0 days.

(21) Appl. No.: 11/221,069

(22) Filed: Sep. 7, 2005

(51) Int. Cl.
*D06F 83/00* (2006.01)

(52) U.S. Cl. ..... 38/140; 38/107

(58) Field of Classification Search ..... 38/103, 38/106, 107, 135, 137, 140; 219/246, 259
See application file for complete search history.

(56) References Cited

U.S. PATENT DOCUMENTS 1,292,977 A * 1/1919 Wilson ..... 38/107
1,659,427 A 2/1928 Danielson
2,267,112 A * 12/1941 Kovalik ..... 38/140
2,458,698 A * 1/1949 Galbraith ..... 38/140
2,472,244 A * 6/1949 Brady ..... 38/107
2,539,804 A 1/1951 Adamec
2,850,817 A 9/1958 Rudd et al.
3,636,644 A * 1/1972 Janetzke ..... 38/140
3,911,603 A * 10/1975 Lehrman ..... 38/140
4,525,942 A * 7/1985 Azzara ..... 38/106
4,751,786 A * 6/1988 Lehrman ..... 38/140
5,566,481 A * 10/1996 Lehrman ..... 38/140
5,926,984 A * 7/1999 Zuber ..... 38/107

* cited by examiner

*Primary Examiner*—Ismael Izaguirre
(74) *Attorney, Agent, or Firm*—Polster, Lieder, Woodruff & Lucchesi, L.C.

(57) ABSTRACT

An apparatus and methods of use for ironing board cover with a heat-resistant and waterproof panel attached to the cover, the panel having a base surface with a continuous brim and a plurality of protuberances capable of supporting an iron. The brim and the base surface form a basin. The protuberances create a gap between the iron and the base surface so that steam can condense onto the panel within the basin to be retained within the panel by the brim. The steam can also dissipate into the ambient atmosphere.

48 Claims, 2 Drawing Sheets

IRONING BOARD COVER WITH PANEL AND METHODS OF USE

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

In the past, ironing board covers have been made from many different materials to provide a support surface for a hot iron that is resistant to scorching and burning from the iron. Some designs incorporate scorch resistant materials into the fabric of the entire cover, while other designs attach separate panels and pads to the cover.

While these previous designs offer limited protection from the heat from an iron, none of these previous designs offer protection from the steam that often emits from an iron. For example, U.S. Pat. No. 6,381,884 discloses an iron having a sole plate with outlet holes for emitting steam. There are many different designs for similar steam irons. In previous designs, the ironing board cover absorbs the steam thereby causing the cover to become damp and resulting in stains on the cover. The cover must then be cleaned to remove the stains, which is an additional task often loathed by the owner.

Therefore, there is a long felt need for a ironing board cover that supports a hot iron and is resistant to both heat and steam, and for methods of use.

SUMMARY OF THE INVENTION

The invention is an ironing board cover assembly for use with an iron having an ironing surface and methods of use. The ironing board cover assembly comprises an ironing board cover with a heat-resistant and waterproof panel attached to the ironing board cover. The panel has a base with a continuous brim defining a basin and a plurality of protuberances capable of supporting the iron. When the iron is placed with the ironing surface facing the panel, the iron is supported by the protuberances so that a gap is formed between the ironing surface and the base to allow steam to flow through the gap about the protuberances and condense in the basin.

DESCRIPTION OF THE DRAWINGS

In the accompanying drawings which form part of the specification.

Corresponding reference numerals indicate corresponding parts throughout the several figures of the drawings.

DETAILED DESCRIPTION

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
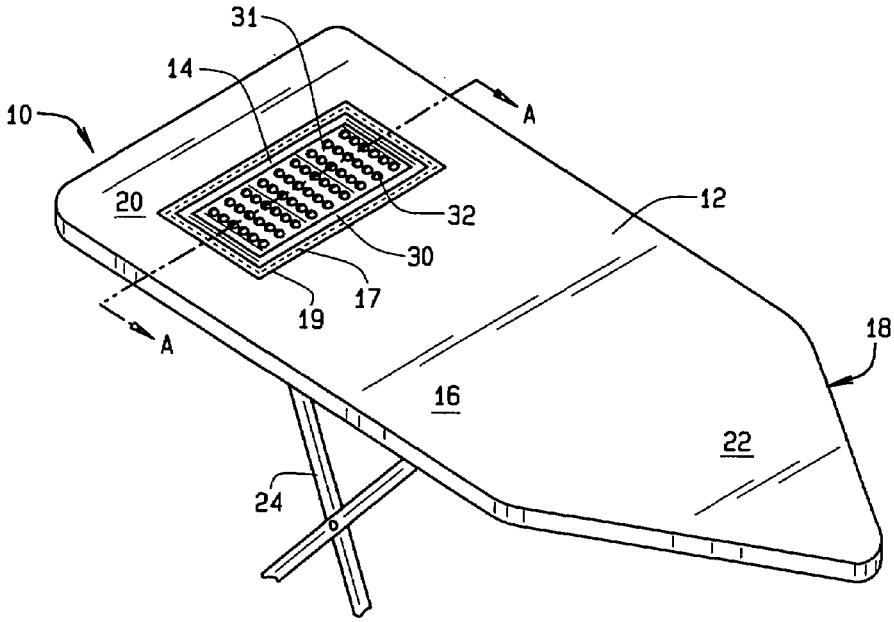
FIG. 1 is a perspective view of a preferred embodiment of an ironing board cover assembly in accordance with and embodying the present invention.
Figure 2:
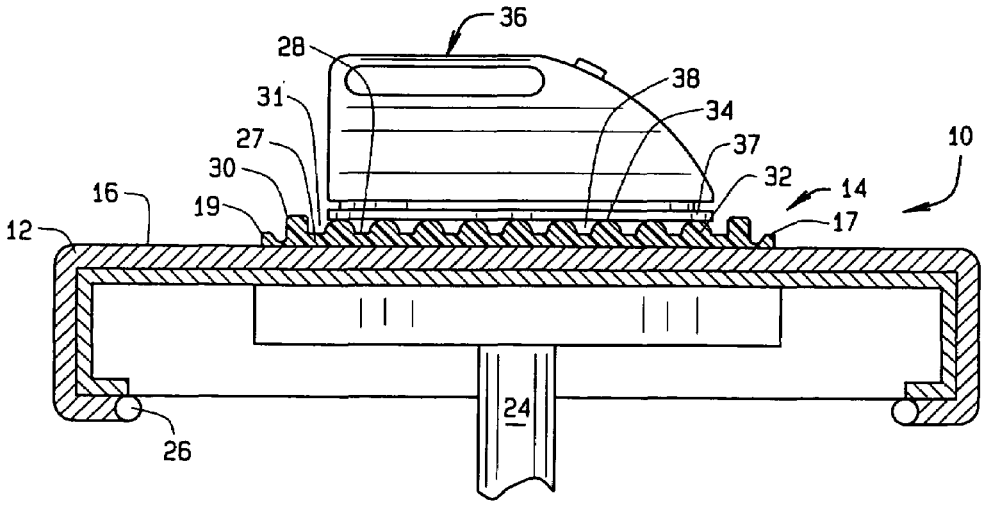
FIG. 2 is a section view taken along A—A of FIG. 1 of the ironing board cover assembly with an iron supported by a panel.

As shown in FIGS. 1–2, a preferred embodiment of the present invention, generally referred to as an ironing board cover assembly 10, includes an ironing board cover 12 having a panel 14 attached to a top surface 16 of the cover 12. The panel 14 is attached preferably to a rear portion of the cover 12 by a thread 17 stitched along the edge 19 of the panel 14.

The cover 12 is shaped to fit over an ironing board 18. The ironing board 18 is embodied as a typical ironing board with a generally rectangular rear portion 20 and a narrowing nose portion 22, which is supported by legs 24. However, those skilled in the art will recognize that any shape of ironing board can be used. The cover 12 also includes a binding 26, including but not limited to a bungee cord, elastic, or drawstring, positioned around the perimeter of the cover 12 for securing the cover 12 to the ironing board 18.

The cover 12 can be made of cotton as known in the art, or can be made from a material with burn/scorch resistant characteristics, such as disclosed in U.S. Pat. No. 5,566,481. In other embodiments, the cover 12 includes multiple layers of materials, including but not limited to a layer of foam padding.

The generally rectangular shaped panel 14 includes a base 27 having an upper surface 28. A continuous unitary brim 30 extends upwardly from the upper surface 28 around the perimeter of the base 27, thereby forming a basin 31. A plurality of protuberances 32 unitary with the base 27 project upwardly from the upper surface 28. In the preferred embodiment, the hemispherically shaped protuberances 32 extend upwardly from the upper surface 28 forming a generally planar lattice of contact points 34, which are capable of supporting an iron 36. In the preferred embodiment, each protuberance is about 7/16" in diameter and each protuberance extends about ¼" from the upper surface 28. However, those skilled in the art will recognize that the size of the protuberences can be any appropriate size that allows steam to flow with minimal restriction. Also the preferred embodiment includes a 6×9 lattice of contact points, but other arrangements of different shapes, sizes, and numbers, can be used.

While the preferred embodiment includes hemispheric protuberances, those skilled in the art will recognize that other shapes can be used, including but not limited to cubical, frusto-conical, pyramidal-frustum, truncated, and catenoid shapes. In alternate embodiments, each protuberance can include more than one contact point.

As shown in FIG. 2, the iron 36 has an ironing surface, also referred to as a sole plate 37. When the sole plate 37 is positioned horizontally onto the protuberances 32, a flow gap 38 is formed between the sole plate 37 and the upper parallel surface 28. The gap extends 38 about the protuberances 32 located beneath the sole plate 37. The flow gap 38 serves as a flow path to allow steam emitting from the iron 36 to dissipate into the ambient atmosphere outside the gap 38 and above the brim 30. The flow gap 38 should be large enough to allow the steam to flow from the iron 36 about the protuberances 32 and into the atmosphere with minimal restriction. The height of the gap 38 is the measurement between the sole plate 37 and the upper surface 28. In the preferred embodiment, the size of the gap 38 is about ¼". However, those skilled in the art will recognize that the size of the gap 38 can be any appropriate size that allows steam to flow with minimal restriction.

The base surface 28 effectively blocks steam from contacting the cover 12, which prevents the cover 12 from absorbing the steam and becoming damp or stained. A portion of the steam will condense onto the panel 14 and be retained within the basin 31.

Figure 3:
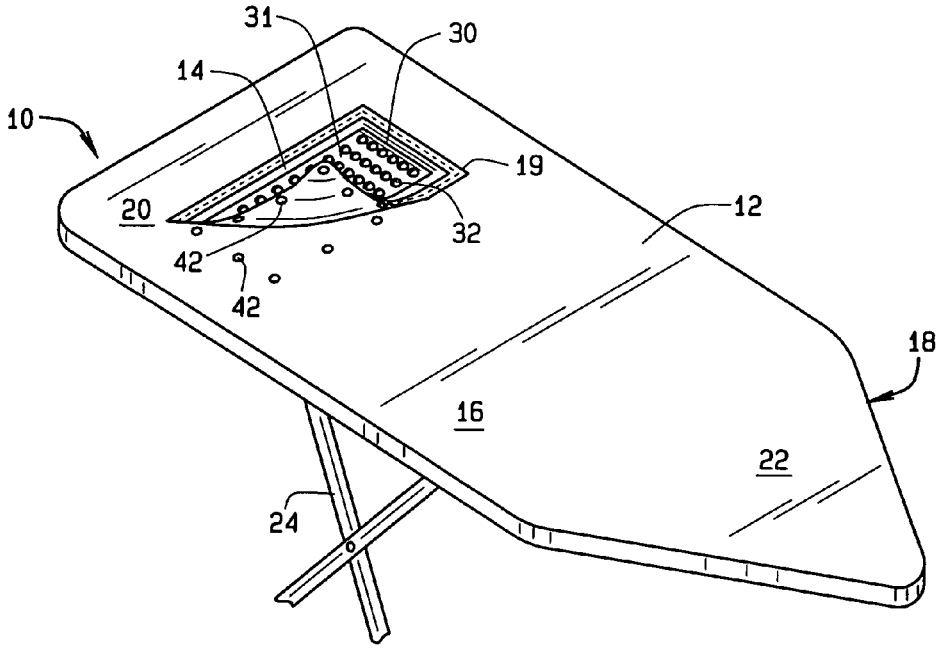
FIG. 3 is a perspective view of an alternate embodiment of an ironing board cover assembly having a removeable panel in accordance with and embodying the present invention.

Those skilled in the art will recognize that other appropriate means of securing the panel 14 can be used, including but not limited to adhesive or removable fasteners, such as snaps. In an alternate embodiment shown in FIG. 3, the panel 14 is removeably attached to the cover 12 with fasteners 42, so that the panel 14 can be easily emptied of condensate. While the present embodiment shows a generally rectangular shaped panel 14 secured to a rear portion of the cover 12, other shapes, including but not limited to circular, trapezoidal, or oblong can be provided. Further, other sizes and locations can be used.

The panel 14 is preferably made from a flexible, heat resistant, and waterproof material including but not limited to elastomers, such as high temperature silicone rubber, having a heat resistance high enough to resist, at peak heating loads for an extended period of time, scorching and burning from direct contact with a hot iron surface and damage from steam. The panel 14 is preferably molded, such as by injection molding, to be one unitary piece.

In operation, the cover 12 is placed over the ironing board 18, with the binding 26 securing the cover 12 underneath the ironing board 18. The operator turns on the iron 36 and begins ironing clothes on the board 18 and cover 12. When not ironing but while the iron 36 and the steam option is on, the operator can place the iron 36 directly onto the panel 14 allowing the sole plate 37 to extend approximately parallel to the base 27. In this position, the sole plate 37 rests on the contact points 34 of the protuberances 32. As mentioned above, the panel 14 prevents the steam from contacting the cover 12 and allows the steam to condense and collect within the basin 31.

Changes can be made in the above constructions without departing from the scope of the invention, it is intended that all matter contained in the above description or shown in the accompanying drawings shall be interpreted as illustrative and not in a limiting sense.

What is claimed is:

1. An ironing board cover assembly for use with an iron having an ironing surface, the ironing board cover assembly comprising:

an ironing board cover;

a heat-resistant and waterproof panel of material capable of resisting scorching and burning of a hot iron surface, the panel being attached to the ironing board cover, the panel having a base with a continuous brim defining a basin and a plurality of protuberances capable of supporting the iron when the iron is placed with the ironing surface facing the panel, the iron is supported by the protuberances with a gap being formed between the ironing surface and the base to allow steam to flow through the gap about the protuberances and condense in the basin and to allow steam to also flow into the ambient atmosphere outside the gap and above the brim.

2. The ironing board cover assembly of claim 1, wherein each protuberance extends upwardly from the base to at least one contact point; and wherein the plurality of protuberances form a generally planar lattice of contact points capable of supporting the iron.

3. The ironing board cover assembly of claim 1, wherein the ironing board cover comprises:

a fabric layer shaped to fit about an ironing board; and a binding around the perimeter of the fabric layer for securing the cover to an ironing board.

4. The ironing board cover assembly of claim 1, wherein the panel comprises a silicone rubber.

5. The ironing board cover assembly of claim 1, further including:

thread stitched about the perimeter of the panel and passing through the cover for securing the panel to the ironing board cover.

6. The ironing board cover assembly of claim 1, further including:

at least one fastener attached to the panel and the cover for removeably attaching the panel to the cover.

7. The ironing board cover assembly of claim 1, wherein:

the panel is rectangular shaped and located generally at the rear section of the ironing board cover; and each protuberance extends upwardly from the base of the panel to at least one contact point, with the plurality of protuberances forming a generally planar lattice of contact points capable of supporting the iron.

8. The ironing board cover assembly of claim 1, wherein the brim is unitary with the base of the panel.

9. The ironing board cover assembly of claim 1, wherein the protuberances are unitary with the base of the panel.

10. The ironing board cover assembly of claim 1, wherein each protuberance comprises a catenoid extending upwardly to a contact point.

11. The ironing board cover assembly of claim 1, wherein each protuberance comprises a hemisphere extending upwardly to a contact point.

12. The ironing board cover assembly of claim 1, wherein the plurality of protuberances are arranged in a parallel rows with each protuberance equidistant from adjacent protuberances.

13. An ironing board cover for use with an iron having an ironing surface, the ironing board cover comprising:

a fabric layer shaped to fit an ironing board;

a binding around the perimeter of the fabric layer for securing the cover to an ironing board;

a heat-resistant and waterproof panel capable of resisting scorching and burning of a hot iron surface, the panel being attached to the ironing board cover, the panel having a base with a continuous brim defining a basin, and a plurality of protuberances extending upwardly from the base and capable of supporting the iron when the iron is placed with the ironing surface facing the panel, to allow the iron to be supported by the protuberances so that a gap is formed between the ironing surface and the base to allow steam to flow through the gap about the protuberances and condense in the basin and to allow steam to also flow into the ambient atmosphere outside the gap and above the brim.

14. The ironing board cover of claim 13, further comprising:

wherein each protuberance extends upwardly from the base to at least one contact point; and wherein the plurality of protuberances form a generally planar lattice of contact points capable of supporting the iron.

15. The ironing board cover of claim 13, wherein the panel comprises a silicone rubber.

16. The ironing board cover of claim 13, further including:

thread stitched through the panel and the cover around the perimeter of the panel for securing the panel to the ironing board cover.

17. The ironing board cover assembly of claim 13, further including:

at least one fastener attached to the panel and the cover for removeably attaching the panel to the cover.

18. The ironing board cover assembly of claim 13, wherein:

the panel is rectangular shaped and located generally at the rear section of the ironing board cover; and each protuberance extends upwardly from the base of the panel to at least one contact point with the plurality of protuberances forming a generally planar lattice of contact points capable of contacting the ironing surface of the iron.

19. The ironing board cover of claim 13, wherein the brim is unitary with the base of the panel.

20. The ironing board cover of claim 19, wherein the protuberances are unitary with the base of the panel.

21. The ironing board cover assembly of claim 13, wherein each protuberance comprises a catenoid extending upwardly to a contact point.

22. The ironing board cover assembly of claim 13, wherein each protuberance comprises a hemisphere extending upwardly to a contact point.

23. The ironing board cover assembly of claim 13, wherein the plurality of protuberances are arranged in a parallel rows with each protuberance equidistant from adjacent protuberances.

24. An ironing board cover assembly for use with an iron having an ironing surface, the ironing board cover assembly comprising:

an ironing board cover;

a means for supporting an iron attached to the ironing board cover, said means having a base with a continuous brim and a plurality of protuberances, and being capable of resisting scorching and burning of a hot iron surface; and wherein the protuberances create a gap between the supported iron and the base surface so that steam from the iron can dissipate and condense within the brim without contacting the ironing board cover and to allow steam to also flow into the ambient atmosphere outside the gap and above the brim.

25. The ironing board cover assembly of claim 24, further comprising:

a plurality of protuberances extends upwardly from the base surface to at least one contact point; and wherein the plurality of protuberances form a generally planar lattice of contact points capable of contacting the ironing surface of the iron.

26. The ironing board cover assembly of claim 24, wherein the means for supporting the iron comprises a silicone rubber.

27. The ironing board cover assembly of claim 24, further including:

stitching through the panel and cover about the perimeter of the panel for securing the panel to the ironing board cover.

28. The ironing board cover assembly of claim 24, further including:

at least one fastener attached to the panel and the cover for removeably attaching the panel to the cover.

29. The ironing board cover assembly of claim 24, wherein:

the panel is rectangular shaped and located generally at the rear section of the ironing board cover; and each protuberance extends upwardly from the base of the panel to at least one contact point with the plurality of protuberances forming a generally planar lattice of contact points capable of contacting the ironing surface of the iron.

30. The ironing board cover assembly of claim 24, wherein the ironing board cover comprises:

a fabric layer shaped to fit an ironing board;

a binding around the perimeter of the fabric layer for securing the cover to an ironing board.

31. The ironing board cover assembly of claim 24, wherein the brim is unitary with the base of the panel.

32. The ironing board cover assembly of claim 24, wherein the protuberances are unitary with the base of the panel.

33. The ironing board cover assembly of claim 24, wherein each protuberance comprises a catenoid extending upwardly to a contact point.

34. The ironing board cover assembly of claim 24, wherein each protuberance comprises a hemisphere extending upwardly to a contact point.

35. The ironing board cover assembly of claim 24, wherein the plurality of protuberances are arranged in a parallel rows with each protuberance equidistant from adjacent protuberances.

36. An ironing board cover assembly for use with an iron having an ironing surface, the ironing board cover assembly comprising:

an ironing board cover having a fabric layer shaped to fit an ironing board and a binding around the perimeter of the fabric layer for securing the cover to an ironing board; and a heat-resistant and waterproof panel attached to a rear section of the ironing board cover, the panel having a base with a continuous brim being unitary with the base and defining a basin, and a plurality of protuberances being unitary with the base and extending upwardly from the base thereby forming a generally planar lattice of contact points capable of supporting the iron when the iron is placed with the ironing surface facing the panel, the panel being capable of resisting scorching and burning of a hot iron surface, the iron being supported by the protuberances so that a gap is formed between the ironing surface and the base to allow steam to flow through the gap about the protuberances and condense in the basin and to allow steam to also flow into the ambient atmosphere outside the gap and above the brim.

37. A method for using an iron having an ironing surface with an ironing board cover assembly comprising the steps of:

providing an ironing board cover;

providing a heat-resistant and waterproof panel, the panel being attached to the ironing board cover, the panel having a base with a continuous brim defining a basin and a plurality of protuberances;

placing an iron onto the panel, the iron being supported by the protuberances with a gap being formed between the ironing surface and the base to allow steam to flow through the gap about the protuberances and condense in the basin and to allow steam to also flow into the ambient atmosphere outside the gap and above the brim.

38. The method of claim 37, wherein each protuberance extends upwardly from the base to at least one contact point; and the plurality of protuberances form a generally planar lattice of contact points capable of supporting the iron.

39. The method of claim 37, further comprising the step of:

providing the ironing board cover with a fabric layer shaped to fit about an ironing board; and providing the ironing board cover with a binding around the perimeter of the fabric layer for securing the cover to an ironing board.

40. The method of claim 37, wherein the panel comprises a silicone rubber.

41. The method of claim 37, further comprising the step of:

providing thread;

stitching the thread about the perimeter of the panel and passing through the cover for securing the panel to the ironing board cover.

42. The method of claim 37, further comprising the step of:

providing at least one fastener attached to the panel and the cover for removeably attaching the panel to the cover.

43. The method of claim 37, wherein the panel is rectangular shaped and located generally at the rear section of the ironing board cover; and each protuberance extends upwardly from the base of the panel to at least one contact point, with the plurality of protuberances forming a generally planar lattice of contact points capable of supporting the iron.

44. The method of claim 37, wherein the brim is unitary with the base of the panel.

45. The method of claim 37, wherein the protuberances are unitary with the base of the panel.

46. The method of claim 37, wherein each protuberance comprises a catenoid extending upwardly to a contact point.

47. The method of claim 37, wherein each protuberance comprises a hemisphere extending upwardly to a contact point.

48. The method of claim 37, wherein the plurality of protuberances are arranged in a parallel rows with each protuberance equidistant from adjacent protuberances.

* * * * *